US006158337A

United States Patent [19]

Hara

[11] Patent Number: 6,158,337

[45] **Date of Patent: *Dec. 12, 2000**

[54] STENCIL-MAKING TYPE PRINTING MACHINE

[75] Inventor: Yoshikazu Hara, Inashiki-gun, Japan

[73] Assignee: Riso Kagaku Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/106,844

[22] Filed: Jun. 30, 1998

[30] Foreign Application Priority Data

Jul. 1, 1997 [JP] Japan ..... 9-191814

[51] Int. Cl.[7] ..... B41L 13/06

[52] U.S. Cl. ..... 101/116; 101/477; 101/484

[58] Field of Search ..... 101/114, 116, 101/117, 118, 119, 120, 129, 477, 484, 485, 486

[56] References Cited

U.S. PATENT DOCUMENTS 5,632,200 5/1997 Fukai ..... 101/116

5,988,061 11/1999 Kagawa ..... 101/128.4

FOREIGN PATENT DOCUMENTS 0 699 541 3/1996 European Pat. Off. .

*Primary Examiner*—Ren Yan

*Attorney, Agent, or Firm*—Pillsbury Madison & Sutro LLP

[57] ABSTRACT

A stencil-making-type printing machine in which plural types of rotary cylindrical drums having printing regions of different sizes can be replaceable loaded, in which a stencil sheet provided in the form of a roll is cut according to the printing region of a rotary cylindrical drum loaded therein to form a printing stencil, and a printing operation is carried out with the printing stencil wound on the rotary cylindrical drum, and before a printing operation is carried out for a new original, a used stencil is separated from the rotary cylindrical drum and discarded into a used-stencil accommodating box by a conveying means. The printing machine comprises a control system which controls operating time of the conveying means depending on the loaded rotary cylindrical drum, thereby stopping the operation of the conveying means immediately after the stencil has been discarded in the accommodating box and surely accommodating the stencil in the accommodating box.

11 Claims, 12 Drawing Sheets

STENCIL-MAKING TYPE PRINTING MACHINE

BACKGROUND OF THE INVENTION

1. Field of the Invention

The present invention relates to a stencil-making-type printing machine in which plural types of rotary cylindrical drums having printing regions of different sizes can replaceably be loaded. In the printing apparatus, a stencil sheet or paper provided in the form of a roll is cut according to the printing region of a rotary cylindrical drum loaded therein to form a printing stencil, and a printing operation is carried out with the printing stencil wound on the rotary cylindrical drum. Before a printing operation is carried out for a new original, a used stencil is separated from the rotary cylindrical drum and discarded into a used-stencil accommodating box by a conveying means.

2. Background

Heretofore, in the case where a printing operation is carried out using a printing machine equipped with a rotary cylindrical drum having a printing region of a size corresponding to, for example, sheet size A3, a printing stencil, which is cut from a roll of stencil sheet and wound on the drum, always has to have a size which covers sheet size A3, even when an original to be duplicated or a printing sheet to be printed is smaller than sheet size A3. Hence, in the case where a printing machine of this type is used to obtain a small number of prints, the cost of the stencil sheet most significantly affects the printing cost per one print.

Considering the above points, a stencil printing machine has been proposed in the art according to which a plurality of rotary cylindrical drums having a printing region different in size among sheet sizes A3, B4 and A4 are prepared and the rotary cylindrical drums are replaced and loaded depending on the size of an original or printing sheet. These rotary cylindrical drums all have the same outer diameter, and in general the respective printing regions that permeate inks are common in their starting point which is located adjacent to the clamp provided along a generating line of the drum, but differ in their end point depending on the respective size. Therefore, the printing stencil in the form of a roll is cut and adjusted to a length according to the printing region of the selected rotary cylindrical drum, whereby the stencil sheet is saved and printing cost can be reduced.

When printing is started with a new original, the used-stencil is removed from the drum and is conveyed to a used-stencil accommodating box by a conveying means such as discharging rollers. In this case, unless the rotation amount of the discharging roller is greater than the rotation amount corresponding to the length of the used-stencil, the whole stencil cannot be accommodated in the used-stencil accommodating box. Therefore, the rotation amount of the discharging rollers is generally set somewhat greater than that corresponding to the maximum length (for example, size A3) of printing stencils usable in the stencil printing machine.

However, when a printing stencil shorter than the maximum length is wound on the rotary cylindrical drum, if the discharging rollers are rotated for discharging the stencil to the rotation amount as set above, the discharging rollers continue to rotate for a while even after the whole stencil is accommodated in the used-stencil accommodating box, and, there occur problems that the stencil once accommodated in the used-stencil accommodating box twines round the discharging rollers and is led out of the box again.

SUMMARY OF THE INVENTION

The object of the present invention is to provide a stencil-making-type printing machine in which plural types of rotary cylindrical drums having printing regions of different size can be loaded one at a time, in which a stencil sheet provided in the form of a roll is cut according to the printing region of a rotary cylindrical drum loaded therein to form a printing stencil, and a printing operation is carried out with said printing stencil wound on said rotary cylindrical drum, and before a printing operation is carried out for a new original, a used printing stencil is separated from said rotary cylindrical drum and discarded into a used-stencil accommodating box by a conveying means, characterized in that the operation of the conveying means at the time of discarding of the stencil is stopped immediately after the stencil has been accommodated in the used-stencil accommodating box, whereby the stencil is surely accommodated in the used-stencil accommodating box.

The above object can be attained by a stencil-making-type printing machine in which plural types of rotary cylindrical drums having printing regions of different size can be loaded one at a time, in which a stencil sheet provided in the form of a roll is cut according to the printing region of a rotary cylindrical drum loaded therein to form a printing stencil, and a printing operation is carried out with said printing stencil wound on said rotary cylindrical drum, and before a printing operation is carried out for a new original, a used printing stencil is separated from said rotary cylindrical drum and discarded into a used-stencil accommodating box by a conveying means, characterized in that the printing machine comprises a control system which controls operating time of the conveying means depending on the loaded rotary cylindrical drum.

The control system can comprise, for example, a detecting means which detects a point of time at which the whole of said used stencil is accommodated in said used-stencil accommodating box and a control means which stops conveying operation of said conveying means in response to information provided by said detecting means. Alternatively, the rotary cylindrical drum may be equipped with a memory means such as RAM which memorizes information on the type or the operating time of the rotary cylindrical drum, whereby the information is given to the machine body at the time of loading the drums, or whereby the machine body can select an operating time depending on the type of the loaded rotary cylindrical drum with reference to a table on the relationship between the types of the drums and the operating times. The table may previously be stored in the machine body. Moreover, a time counting means such as CPU may be installed in the rotary cylindrical drums, whereby a signal to stop the conveying means can be transmitted to the machine body at a point of time when the conveying means reaches a predetermined operating time.

In the stencil-making-type printing machine of the above kind, usually the whole used printing stencil is accommodated in the used-stencil accommodating box during one rotation of the drum which rotation is regulated in a predetermined manner, and, therefore, the accommodating process of the printing stencil has a correlation with rotation angle of the drum. Accordingly, it is convenient that the detecting means is a means which detects a rotation angle of the drum at a point of time when the used stencil is wholly accommodated in the used-stencil accommodating box.

According to the first embodiment of the present invention, such detecting means as above can comprise a first detection board fixed at a peripheral edge of the rotary cylindrical drum, a second detection board fixed at a peripheral edge of the drum apart from the first detection board by the above-mentioned rotation angle in reverse direction to the rotation of the drum, and a stationary sensor which detects both the first and second detection boards. Preferably, the first detection board is provided at the position where it is detected by the sensor when the drum begins to rotate in discharging of used-stencil, and the control means can be such that stops the conveying operation of the conveying means in response to detection of the second detection board by the sensor.

Furthermore, according to the second embodiment of the present invention, the detecting means can comprise a means for detecting a type of a loaded rotary cylindrical drum and a means for detecting the rotation angle of the drum at a point of time when the whole printing stencil wound on the drum is accommodated in the used-stencil accommodating box. In this case, the means for detecting a type of a loaded drum can comprise a first detection board fixed at a peripheral edge of the drum, a second detection board fixed at a peripheral edge of the drum apart from the first detection board by the above-mentioned rotation angle in reverse direction to the rotation of the drum, and a stationary sensor which detects both the first and second detection boards; the means for detecting the rotation angle of the drum can comprise a memory means for memorizing the rotation angle obtained based on detection of both the first and second detection boards by the sensor and a drum rotation monitoring means which monitors the rotation angle of the drum to detect that the drum has rotated up to the rotation angle memorized in the memory means; and the control means can be a means which stops the conveying operation of the conveying means in response to the detection by the drum rotation monitoring means.

Moreover, according to the third embodiment of the present invention, the detecting means may comprise a means for detecting a type of a loaded rotary cylindrical drum, a first memory means for storing information on all usable types of rotary cylindrical drums and corresponding rotation angles at a point of time when the used stencil is wholly accommodated in the used-stencil accommodating box, a second memory means for retrieving and memorizing a rotation angle from the first memory means depending on the type of a drum detected by the means for detecting a type of a loaded drum, and a drum rotation monitoring means which monitors the rotation angle of the drum to detect that the drum has rotated up to the rotation angle memorized in the second memory means. In this case, the control means may be a means which stops the conveying operation of the conveying means in response to the detection by the drum rotation monitoring means of the rotation angle memorized in the second memory means.

In the third embodiment, the means for detecting a type of a loaded rotary cylindrical drum may be one which detects it based on information derived from dip switches that are set up depending on types of the drums, or can comprise a first detection board fixed at a peripheral edge of the drum, a second detection board fixed at a peripheral edge of the drum apart from the first detection board by an angle which differs depending on types of drums, and a stationary sensor which detects both the first and second detection boards. As the second detection board, there may be utilized, for example, a known detection board which is provided at a peripheral edge of a drum for operating a cutter at a timing to cut the printing stencil to a length corresponding to the kind of the drums upon winding the stencil in conventional stencil-making-type printing machines.

The drum rotation monitoring means is preferably an encoder which is connected to the rotary cylindrical drum or to a shaft of a motor which drives the drum.

DETAILED DESCRIPTION OF THE PREFERRED EMBODIMENTS

Figure 1:
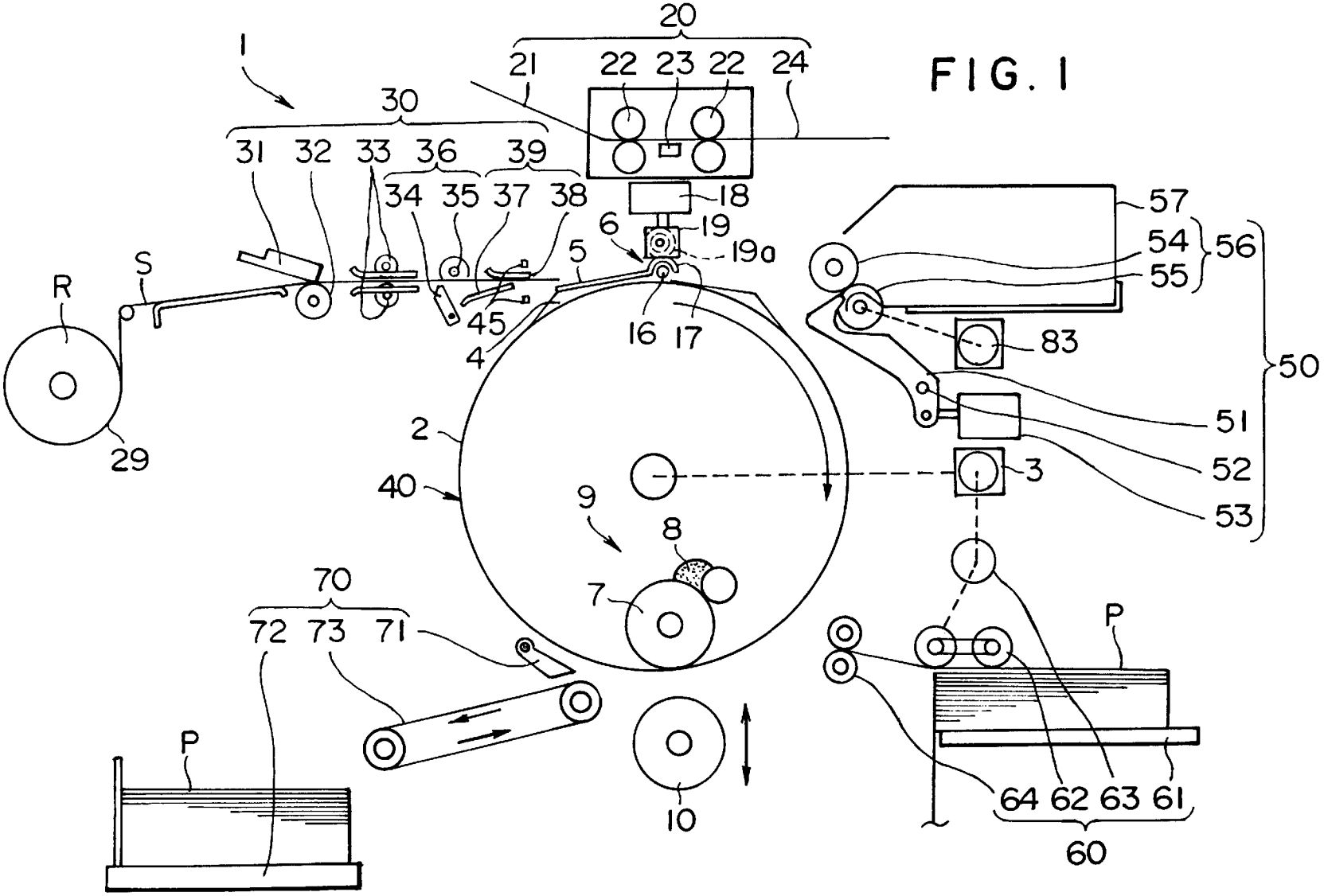
FIG. 1 is an explanatory diagram showing the arrangement of an example of a stencil-making-type printing machine according to the invention.

FIG. 1 shows a stencil-making printing machine, which constitutes an embodiment of the invention. The machine 1 comprises an original image reading section 20, a heat-sensitive type stencil making section 30, a stencil printing mechanism section 40, a stencil discharging section 50, a sheet supplying section 60, and a sheet discharging section 70.

The original image reading section 20, as shown in FIG. 1, comprises an original placing stand 21 on which an original to be printed out is placed, a pair of original conveying rollers 22 for conveying the original which is set on the original placing stand 21, a contact type image sensor 23 which optically reads the image of an original and converts it into electrical signals, and an original discharging tray 24 on which originals that have been read by the image sensor 23 are stacked.

The original image reading section 20 starts its operation when stencil formation start button on a known operating panel (not shown) is depressed after an original is set on the original placing stand 21.

The stencil making section 30 has a thermal head 31 having a plurality of heat generating elements which are paired vertically and arranged in a direction perpendicular to the surface of the drawing and a platen roller 32 confronted with the thermal head 31. A stencil sheet roll holding section 29 is provided on the left side of the stencil making section 30 in FIG. 1. The section 29 holds a roll R of stencil sheet which is formed by winding a belt-shaped heat-sensitive stencil sheet S. In the section 29, the roll can be replaced with another when necessary. Adjacent to the thermal head 31 and the platen roller 32, a pair of stencil sheet conveying rollers 33 arranged vertically, a stencil sheet cutter 36, and a stencil guide board assembly 39 are provided. The stencil sheet cutter 36 consists of a stationary blade 34 and a movable blade 35 provided above the stationary blade, to cut the stencil sheet S in which the image of an original has been perforated, to form a printing stencil. The stencil guide board assembly 39 comprises a lower guide board 37 and an upper guide board 38, for guiding the stencil sheet S to a clamping section 6 on a rotary cylindrical drum 2 (described below).

In the stencil making section 30, the stencil sheet S fed out of the stencil sheet roll R is conveyed by the platen roller 32 and the pair of stencil sheet conveying rollers 33, and the image of a given original is thermally perforated in it with the thermal head 31. Thereafter, one sheet portion of the stencil sheet S in which the image of original has been perforated is cut out by the stencil sheet cutter 36 and conveyed to the rotary cylindrical drum 2 referred to hereinafter.

The stencil making section 30 further comprises a stencil sheet holding sensor 45 which is used in order that, after a printing stencil is formed by cutting the stencil sheet S with the stencil sheet cutter 36, the leading edge of the stencil sheet S thus cut is conveyed over the stencil sheet cutter 36 to a predetermined position on the stencil guide board assembly 39, and the stencil sheet S is held there until the next stencil making operation starts. That is, the stencil sheet holding sensor 45 detects the leading edge of the stencil sheet S which has been cut in the above-described manner. Upon detection of the leading edge of the stencil sheet, the platen roller 32 and the pair of stencil sheet conveying rollers 33 are rotated until the leading edge of the stencil sheet S is conveyed a predetermined distance. The heat generating elements of the thermal head 31 generate heat according to the image signal output by the image sensor 23 in the original image reading section 20, so that the image of the original is perforated in the stencil sheet S.

The sheet supplying section 60 comprises a sheet supplying stand 61 on which printing sheets or paper P are stacked and which is moved vertically by a vertically moving mechanism not shown, pick-up rollers 62 which take out printing sheets P one by one from the paper supplying stand 61, a paper supplying clutch 63 which intermittently transmits rotation of main motor 3 to the pick-up rollers 62, and a pair of paper conveying rollers 64 which feed the printing sheets P at a given timing between the drum 2 and press roller 10.

The sheet discharging section 70 comprises a removing claw 71 which removes printed paper P from the drum 2, and a belt-conveyor type sheet discharging and conveying device 73 which conveys the printed papers P removed from the drum 2 to the sheet discharging stand 72 and stack them thereon.

As shown in FIG. 1, the stencil printing mechanism section 40 has the rotary cylindrical drum 2 which can be rotated around its central axis. The drum 2 is rotated clockwise (in FIG. 1) by a main motor 3. The cylindrical wall of the drum 2 has an ink passage structure serving as a printing region (hereinafter "ink passage region" when applicable). That is, when the drum 2 is for sheet size A3, the ink passage region is, for instance, 300 mm in axial 2.0 length, and 440 mm in circumferential length; and when the drum 2 is for sheet size A4 portrait, size of its ink passage region is, for instance, 220 mm in axial length, and 300 mm in circumferential length.

A stage member 4 is provided on the outer surface of the ink non-passage region of the cylindrical wall of the drum in such a manner that it is extended in the direction of a generating line of the cylindrical wall. On the stage member 4, a stencil clamping board 5 is provided to cooperate with the stage member 4 to clamp one end of a stencil sheet S. The stencil clamping board 5 is mounted on a shaft 16 with a gear 17. A clamp solenoid 18 shown in FIG. 1 is provided on a machine body frame (not shown) which is stationary. The clamp solenoid 18 is adapted to move a clamp drive unit 19 vertically which is made up of a drive gear 19*a*, and a clamp motor (not shown) adapted to rotate the drive gear 19*a*, so as to selectively engage the latter 19*a* with the gear 17 of the shaft 16.

The drive gear 19*a* thus engaged with the gear 17 is rotated, so that the stencil clamping board 5 is rotated approximately 180 degree(s) on the stage member 4 of the drum 2. More specifically, the stencil clamping board 5 is rotated about the shaft 16 between a clamp position (the position shown in FIG. 1) where it cooperates with the stage member 4 to clamp one end of the stencil sheet S which is transferred from the stencil making section 30, and a non-clamp position which is spaced angularly about 180 degree (s) from the clamp position.

An ink supplying mechanism 9 including a squeegee roller 7 and a doctor rod 8 is provided inside the rotary cylindrical drum 2 and can supply an ink to the inner peripheral surface of the drum 2. A press roller 10 is provided below the drum 2 in such a manner that it is vertically movable. The press roller 10 pushes the printing sheet P against the outer peripheral surface of the rotary cylindrical drum 2 which is supplied in synchronization with the rotation of the drum 2, so that the printing ink supplied through the ink passage region of the rotary cylindrical drum 2 and the perforated region of the stencil sheet S is transferred onto the printing sheet P.

Figure 2:
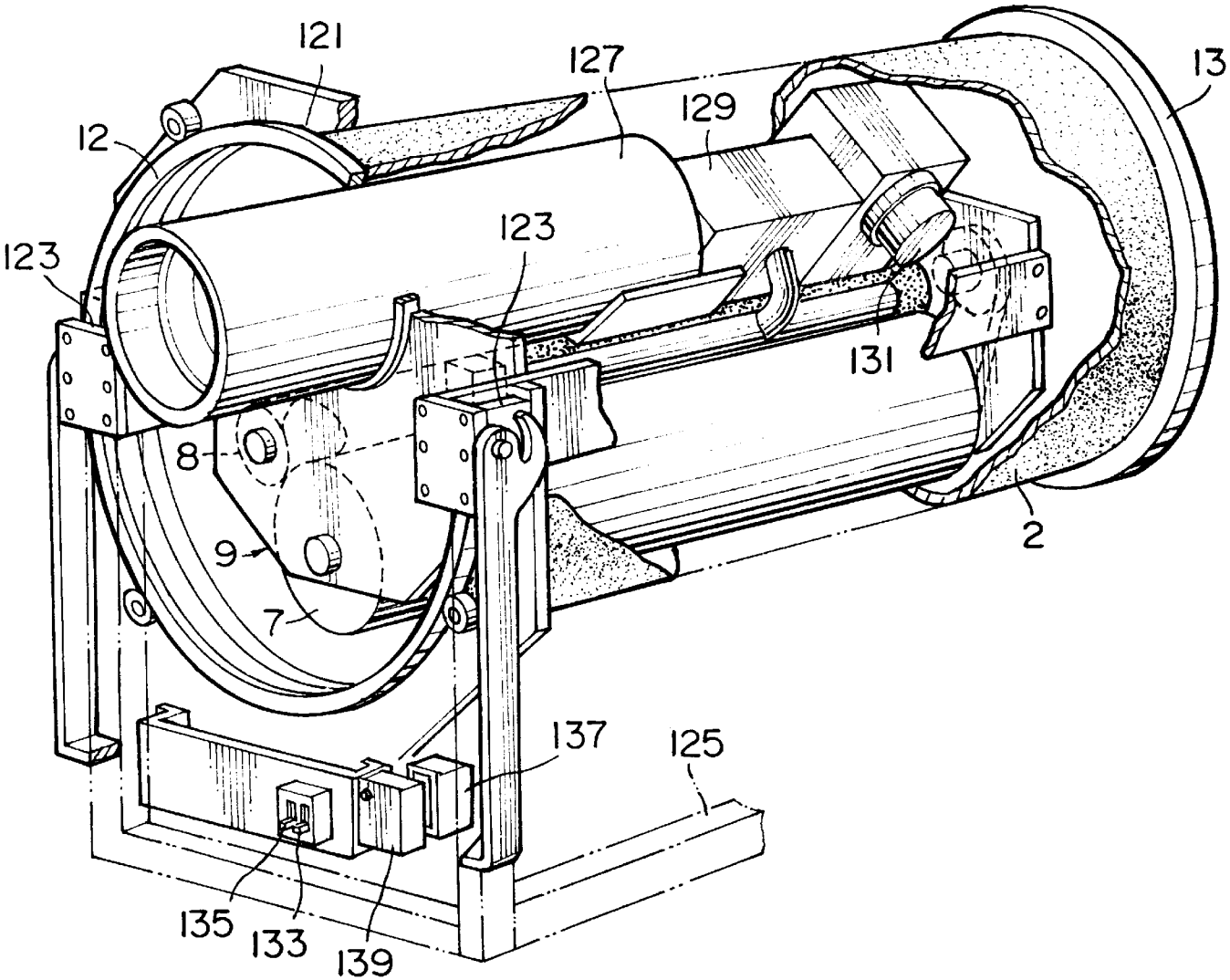
FIG. 2 is a perspective view, with parts cut away, showing the structure of a rotary cylindrical drum in the printing machine.

The structure of the rotary cylindrical drum 2 will be described in more detail. As shown in FIG. 2, the drum 2 is rotatably supported by a drum support 121; that is, the drum 2 and the drum support 121 are provided as a unit in which the drum 2 is rotatably supported by a supporting plate on which engaging sections 123 are formed. With the aid of engaging sections 123 formed on the drum support 121, the unit is detachably engaged with a movable drum supporting frame 125 which is slidably disposed on a machine body frame (not shown) so that it may be moved into and out of the printing machine 1. Hence, in order to replace the drum 2, the unit is drawn out of the printing machine with the aid of the movable drum supporting frame 125. An ink bottle 127 containing printing ink, an ink-supplying pump 129 for feeding printing ink from the bottle 127 to the ink supplying section 9, and an ink-supplying-pump driving motor 131 are supported by the drum support 121 inside the rotary cylindrical drum 2.

Figure 3A:
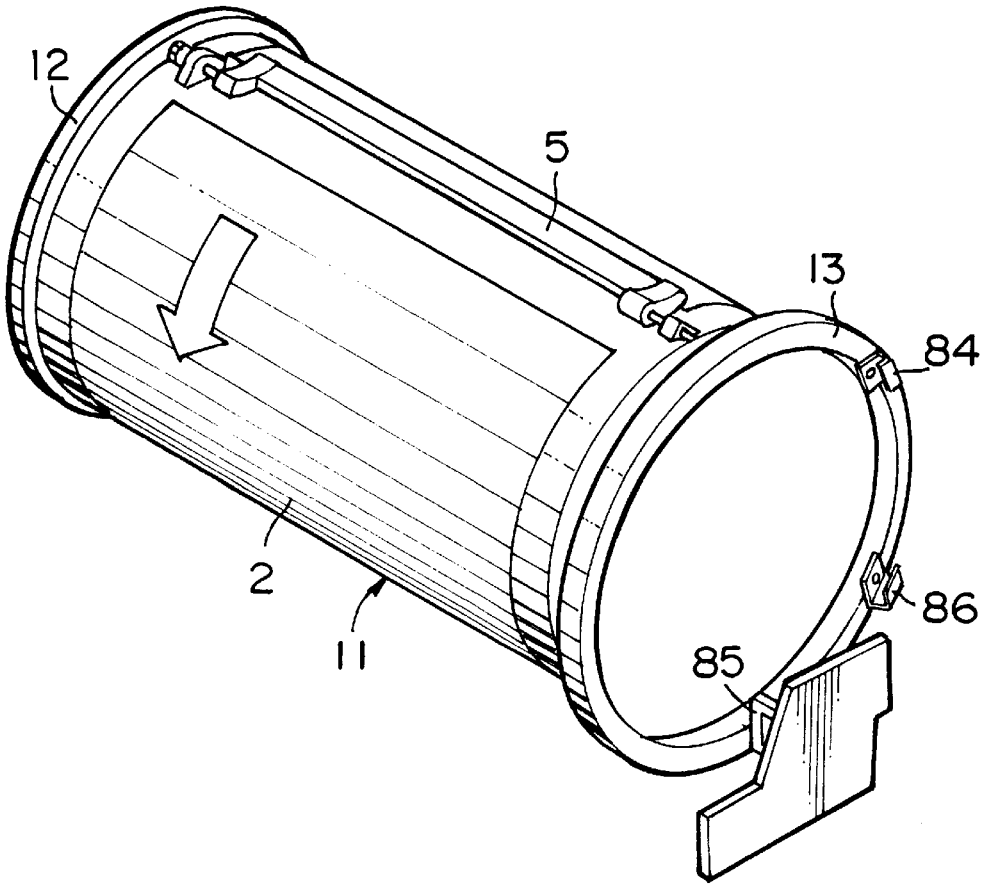
FIG. 3(*a*) is a perspective view showing a structure of a detecting means for detecting desired drum rotational position, mounted on the rotary cylindrical drum in the printing machine, which is adapted to output a timing signal for a stencil sheet cutter and a pair of stencil discharging rollers, and FIG. 3(*b*) is a partially enlarged perspective view showing the drum rotational position sensor.
Figure 3B:
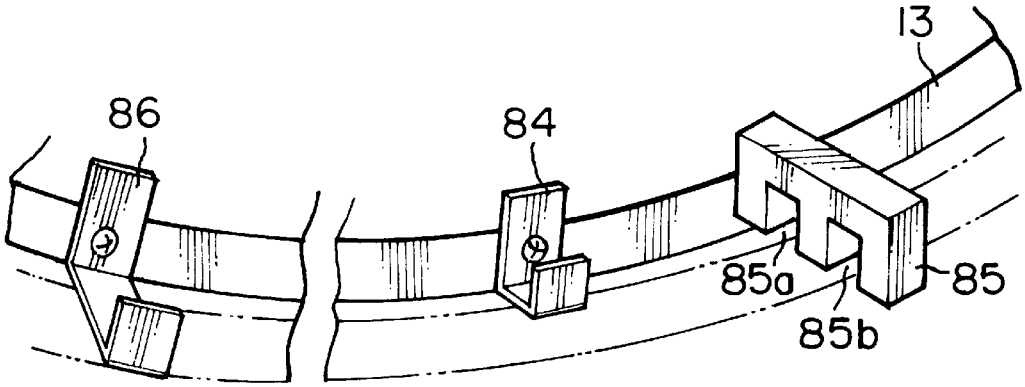

A rotary cylindrical drum 2 is loaded in the printing machine 1, which may be selected from plural types of drums 2 different in printing regions according to the sheet size, for instance, A3, A4, etc., but equal in diameter and in axial length to one another. As shown in FIG. 3, the drum 2 is made up of a cylindrical wall 11, and a pair of rigid flanges 12 and 13 fixedly fitted in both ends of the cylindrical wall 11 with fixing means such as screws. Thus, the shape of the resultant drum 2 as a whole is maintained cylindrical. One or two screens (not shown) are wound on the outer cylindrical surface of the drum 2 to uniformly disperse the printing ink which is supplied thereto from inside.

Figure 4:
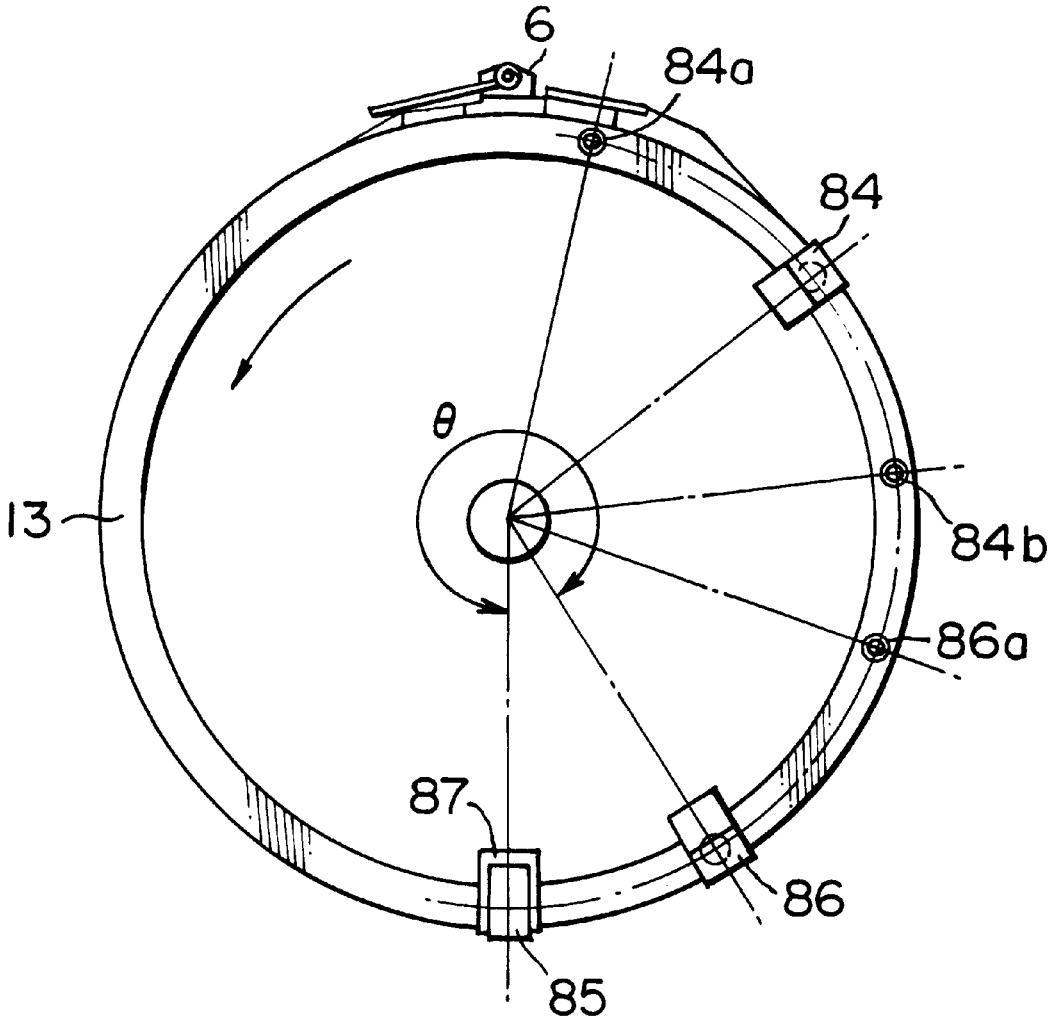
FIG. 4 is a side view of the drum of FIG. 3.

As shown in FIG. 4, a first detection board 87 is provided at a peripheral or side edge portion of one of the flanges 12 and 13 at such a position that it overlaps a drum home position sensor 85 disposed on the machine body frame when the clamp section 6 is positioned right above. This position is a home position of the drum 2, at which the drum 2 stops, the clamp board 5 of the clamp section 6 can be driven, and the drum 2 can be taken out and put in the printing machine.

Furthermore, as shown in FIG. 3, a second detection board 84 is provided at a peripheral or side end portion of one of flanges 12 and 13 of the drum 2, so as to determine the length of a stencil sheet S which is to be cut and wound on the drum. In the example shown in FIG. 3, the sensor 85 is an interruption type photo sensor, and the first detection board 87 and the second detection board 84 are shielding boards for the photo sensor, but other means attaining the same function may be employed. As most plainly shown in FIG. 3(*b*), the sensor 85 has two grooves 85*a* and 85*b*, and the first detection board 87 and the second detection board 84 both pass through the groove 85*a* and shield the light of the groove when they pass therethrough. When the sensor 85 first detects that the drum 2 is in the state of the clamp section 6 being positioned right above and then detects that the second detection board 84 passes through groove 85*a*, the stencil sheet cutter 36 is driven to cut the stencil sheet S.

Therefore, by appropriately setting the position of the second detection board 84 depending on the type of the drum 2, the printing machine is enabled to recognize the length of the stencil sheet S to be wound around the outer surface of the drum 2. For instance, in the case where the drum 2 is one which has a printing region of size B4, the second detection board 84 is so positioned that the stencil sheet S is cut to a predetermined length longer than the ink passage region of the drum which corresponds to sheet size B4. In the case where the drum 2 for size A3 is employed, the second detection board 84 may be moved to hole 84*b* and secured therein by a screw or a rivet, which meets the sensor 85 when the stencil sheet S is cut to a predetermined length longer than the ink passage region of the drum which corresponds to sheet size A3. In the case where the drum 2 for size A4 is employed, similarly the second detection board 84 may be secured by a screw or a rivet at hole 84*a* which meets the sensor 85 when the stencil sheet S is cut to a predetermined length longer than the ink passage region of the drum which corresponds to sheet size A4. By the way, if the drum 2 is for A3, the size of the stencil sheet S to be cut is 320 mm×515 mm, and if the drum 2 is for A4, the stencil sheet S is cut to form a printing stencil of 320 mm×310 mm.

As described above, the stencil-making-type printing machine of the invention is provided with a plurality of rotary cylindrical drums 2 having different printing regions such as a size-A3 drum having an ink passage region corresponding to sheet size A3, and a size-A4 drum having an ink passage region corresponding to sheet size A4. These drums are loaded in the printing machine one at a time according to stencil printing operations to be performed. A mechanism for replacing a rotary cylindrical drum 2 with another has been disclosed in Examined Japanese Patent Application Publication Nos. Sho. 62-28758 and Hei. 4-46236 in detail.

Whilst the first detection board 87 is disposed at a fixed position irrespective of the type of the drum, the second detection board 84 is positioned at different positions depending on the size of the printing region of the drum as mentioned above. Therefore, type of the drum can be known by detecting an angle between the first detection board 87 and the second detection board 84. That is, the second detection board 84 can be used not only as a driving control means for sheet cutter 34, but also as a means for detecting the type of the drum.

As a means for detecting the type of the drum, dip switches 133 and 135 provided at the drum support 121 can also be used. These dip switches 133 and 135 can provide four modes by the combination of "on" and "off" states. For instance, the dip switches 133 and 135 are both turned off when the drum is one which has a printing region corresponding to sheet size A3; and the dip switch 133 is turned off while the dip switch 135 is turned on, when the drum is one which has a printing region corresponding to sheet size A4. That is, the four respective modes based on the "on" and "off" states of the dip switches can be assigned to four respective rotary cylindrical drums different in printing region. In addition, the drum support 121 has an electrical connector 139 which is automatically connected to an electrical connector 137 of the printing machine 1 when the drum 2 is loaded in the latter 1. Through those electrical connectors 137 and 139 thus connected together, data on the "on" and "off" states of the dip switches 133 and 135 is transmitted to a control system (described later) in the printing machine 1.

In the above-described embodiment, the dip switches 133 and 135 can be employed to detect the types of rotary cylindrical drums, however, they may be replaced by the following means. Different drum supports 121 which support different rotary cylindrical drums (different in printing region) are so designed to have a different number of slits, or slits at different positions, respectively; while the printing machine body has sensors in correspondence to the slits. In this case, when a rotary cylindrical drum 2 is loaded in the printing machine body, the specific type of drum can be determined from the slits which are detected by sensors provided on the side of the printing machine body. In addition, the following means may be employed. That is, drum supports 121 supporting different rotary cylindrical drums 2 may have different bar codes, and the printing machine body may have a bar code reading device, so that when a rotary cylindrical drum 2 is loaded in the printing machine body, the bar code is read to identify the drum 2.

Referring back to FIG. 1, the stencil discharging section 50 has a stencil discharging claw 51. The claw 51 is pivotally mounted on a shaft 52, and its base end portion is coupled to a stencil-discharging-claw driving solenoid 53 so that th e claw 51 may be rotated at a predetermined angle about the shaft 52. More specifically, the stencil discharging claw 51 is rotatable between a stencil sheet separating position where the front end portion of the claw 52 approaches the outer cylindrical surface of the drum 2 to separate the stencil sheet S from the latter 2, and a standby position which is spaced at a predetermined distance from the drum 2.

The stencil sheet S separated from the drum 2 is moved away from the drum 2, to the right side of the stencil discharging claw 51. On the right side of the claw 51, a pair of stencil discharging rollers 56, or upper and lower rollers 54 and 55, are provided as a means for conveying a stencil sheet S. The rollers are driven by a stencil conveying motor 83, to convey a stencil sheet separated from the drum 2. Adjacent to the pair of the stencil discharging rollers 56 in the conveying direction of stencil sheets, a used-stencil accommodating box 57 is provided to receive used stencils which are conveyed thereto by a pair of the stencil discharging rollers 56. The conveying means can be a belt type conveying device and is not limited to the one shown in the drawings.

In the present invention, the pair of stencil discharging rollers 56 is controlled so that immediately after the whole used-stencil has been conveyed to the used-stencil accommodating box 57, the conveying operation is stopped. This control means stops the conveying operation after a pair of the stencil discharging rollers 56 operate in such a degree as necessary and sufficient to convey the whole stencil sheet S to the used-stencil accommodating box 57. In the example shown in FIG. 1, at the time of discharging the stencil, the drum 2 makes one rotation at a constant rate in the direction of arrow synchronizing with a pair of the stencil discharging rollers 56, and a pair of the stencil discharging rollers 56 are set at such a given rotation speed that the whole stencil is accommodated in the used-stencil accommodating box 57 during one rotation of the drum 2. Thus, quantity of operation of a pair of the stencil discharging rollers 56 before the whole stencil sheet S has been accommodated in the used-stencil accommodating box 57 can be adapted to an angle of rotation of the drum at discharging of a stencil. In the specific example shown in FIG. 4, a third detection board 86 representing the rotation angle θ when a pair of the stencil discharging rollers 56 have conveyed the whole stencil sheet S to the used-stencil accommodating box 57 is provided at a side edge portion of one of flanges 12 or 13 of the drum 2. By the way, for instance, this rotation angle can be 328° when the drum 2 is of sheet size B4, 290° when the drum 2 is of sheet size A4 portrait, 240° when the drum 2 is of sheet size A4 landscape, and 0° when the drum 2 is of sheet size A3. That is, when the drum 2 is for sheet size A3, the third detection board 86 may be used as the first detection board 87.

The third detection board 86 can be a shielding board which shields the interrupt type sensor like the first and second detection boards 87 and 84, and in the example shown in the drawing, it is arranged so that it passes through groove 85*b* of the drum home position sensor 85. Therefore, by controlling the pair of stencil discharging rollers 56 to stop the conveying operation in response to the passing of the third detection board 86 through the groove 85*b* of the sensor 85 upon rotation of the drum 2 at the time of discharging the stencil, the subsequent unnecessary rotation of a pair of the stencil discharging rollers 56 can be prevented and, besides, the trouble of once accommodated stencil sheet S twining round the stencil discharging rollers 54, 55 and going out of the box can be prevented. In the example of FIG. 4, the sensor 85 has two grooves 85*a* and 85*b*, but the first, second and third detection boards may pass through a common one groove if the sensor 85 can separately detect the respective detection boards. The first detection board 87 is provided at a fixed position irrespective of the type of the rotary cylindrical drum while the third detection board 86 is provided at different positions depending on the size of printing region of the drum 2 as mentioned above. Therefore, the type of the drum can be known by detecting the difference in angle between the first detection board 87 and the third detection board 86. That is, the third detection board 86 can be used not only as the detecting means for detecting a point of the time when the whole stencil sheet S has been accommodated in the used-stencil accommodating box, but also as a detecting means for detecting the type of the drum.

Another embodiment of the detecting means as an alternative to the third detection board 86 is that an encoder (not shown) is connected to the rotating shaft of the drum 2 or main motor 3 for driving the drum as a drum rotation monitoring means so that rotation angle of the drum 2 can be monitored, and at the time of discharging of stencil sheet, control may be carried out so that the conveying operation of a pair of the stencil discharging rollers 56 is stopped when the drum 2 has rotated by the above angle θ. The encoder can be, for example, such as having radially drilled 360 slits, and an interrupt type photo sensor may be arranged at the circumference thereof to monitor the rotation angle of the drum 2. In FIG. 4, taking as a home position the state in which the first detection boards 87 overlaps the interrupt type sensor 85, the conveying operation of the pair of stencil-discharging rollers 56 can be stopped when the photo sensor detects 328 times in the case of the drum 2 being for the size B4, when the photo sensor detects 290 times in the case of the drum being for the size A4 portrait, and when the photo sensor detects 240 times in the case of the drum being for the size A4 landscape. In the case of the drum 2 being for the size A3, the conveying operation of the pair of stencil discharging rollers 56 may be stopped when the first detection board 87 again reaches the home position.

The control means for stopping the conveying operation of a pair of the stencil discharging rollers 56 may be a means for turning off the stencil conveying motor 83 of a pair of the stencil discharging rollers 56 or a means for keeping a stencil discharging roller 55 in idling state by connecting the stencil discharging roller 55 and the stencil conveying motor 83 through a clutch and canceling the clutch in response to the above detecting means. In addition, it may be a means for separating the discharging roller 55 and the discharging roller 54 from each other.

Figure 5:
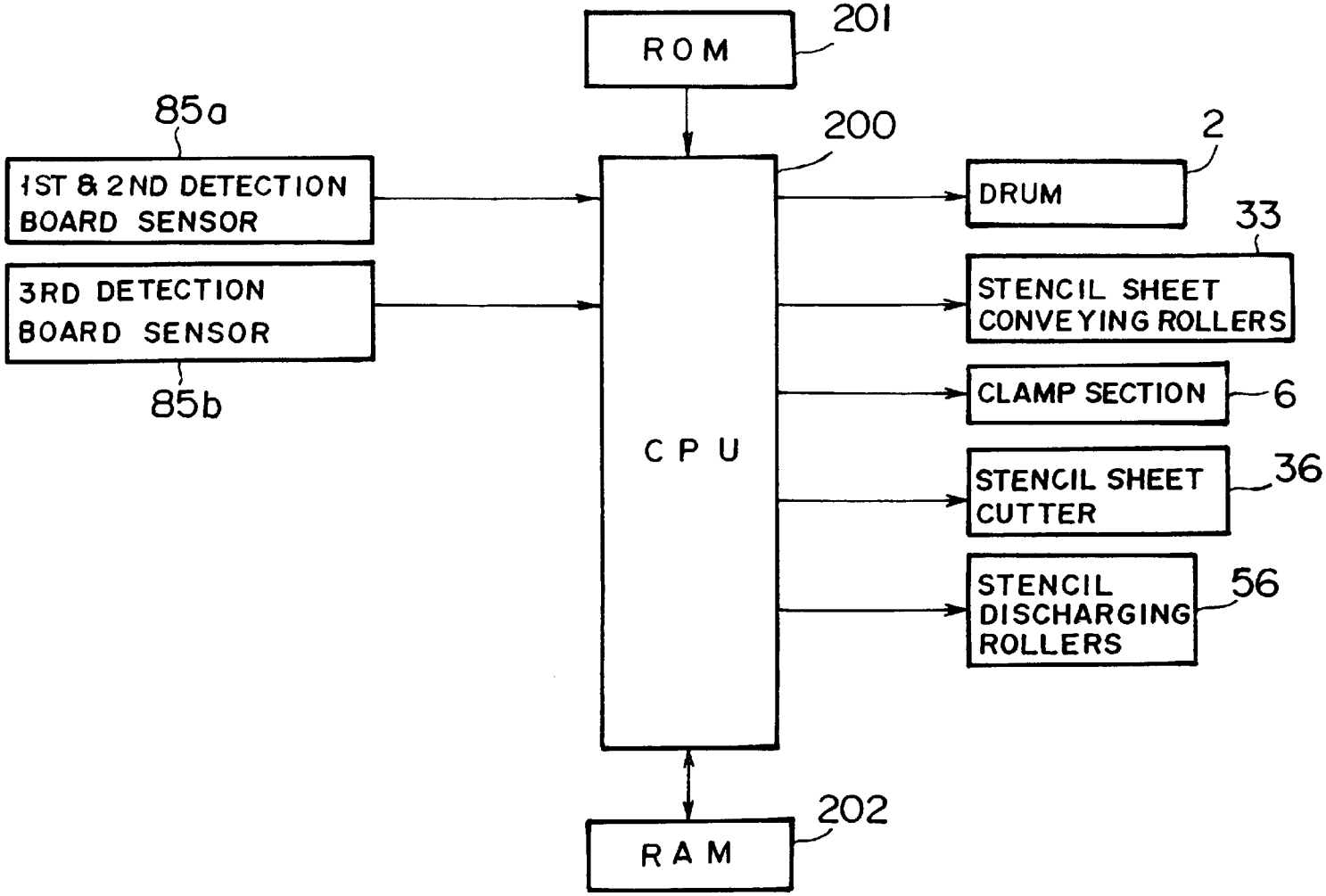
FIG. 5 is a block diagram showing the arrangement of an example of a control system of the printing machine.

FIG. 5 schematically shows one example of control system of the printing machine 1 which uses the third detection board 86 shown in FIG. 4 as a detecting means for detecting a point of time at which the whole stencil sheet S is accommodated in the used-stencil accommodating box 57. This control system has a construction to control the operations of drum 2, sheet conveying rollers 33, clamp board 6, sheet cutter 36 and a pair of stencil discharging rollers 56 based on the signals detected at grooves 85*a* and 85*b* of the interrupt type sensor 85 by means of a CPU 200 composed of a microprocessor and others and programs thereof as well as ROM 201 and RAM 202 connected to CPU 200.

Figure 6:
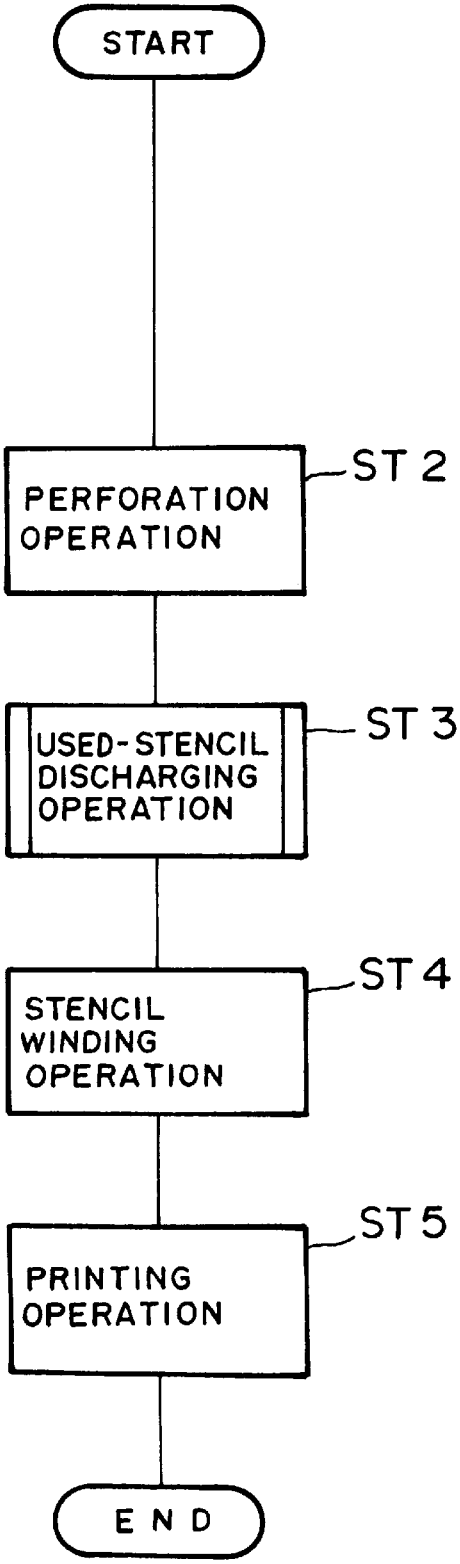
FIG. 6 is a flow chart showing one example of the operation of the printing machine.

The operation of the stencil-making-type printing machine based on the control system of FIG. 5 will be explained with reference to a flow chart of FIG. 6. First, upon depression of the start button in the stencil making mode, the original image reading section 20 scans an image of a given original to provide image information, and the stencil making section 30 perforates the image of the original in a stencil sheet S (provided in the form of a roll) according to the image information, to form a printing stencil (Step ST2). At the same time, the stencil discharging section 50 operates to separate the used stencil from the rotary cylindrical drum 2 and discharge it (Step ST3). After the used stencil has been discharged, the front end portion of the perforated stencil sheet S is secured to the drum 2 with the stencil clamping board 5, and under this condition the drum 2 is turned so that the stencil sheet S is wound on the outer cylindrical surface of the drum 2. When the sensor 85 detects the passage of the second detection board 84 mounted on the edge of one of the flanges 12 and 13; that is, when it is detected that the drum 2 has rotated at a predetermined angle, the stencil sheet cutter 36 cuts the stencil sheet S. Thus, the printing stencil has been wound on the drum 2 (Step ST4).

Next, in the printing mode, the number of prints to be formed is preset, and the start button is depressed. In response to the depression of the start button, the drum 2 is rotated. A printing sheet P, supplied from the sheet supplying section 60 in synchronization with the rotation of the drum 2, is pressed by a press roller 10 against the outer cylindrical surface of the drum 2, so that the printing ink supplied through the ink passage region of the drum 2 and the perforating region of the stencil is transferred onto the printing sheet P. The printing sheet P is separated from the drum 2 by the sheet discharging section 70, and delivered onto the sheet discharging stand 72 (Step ST5). The above-described printing operation is repeatedly carried out until the preset number of prints are obtained.

Figure 7:
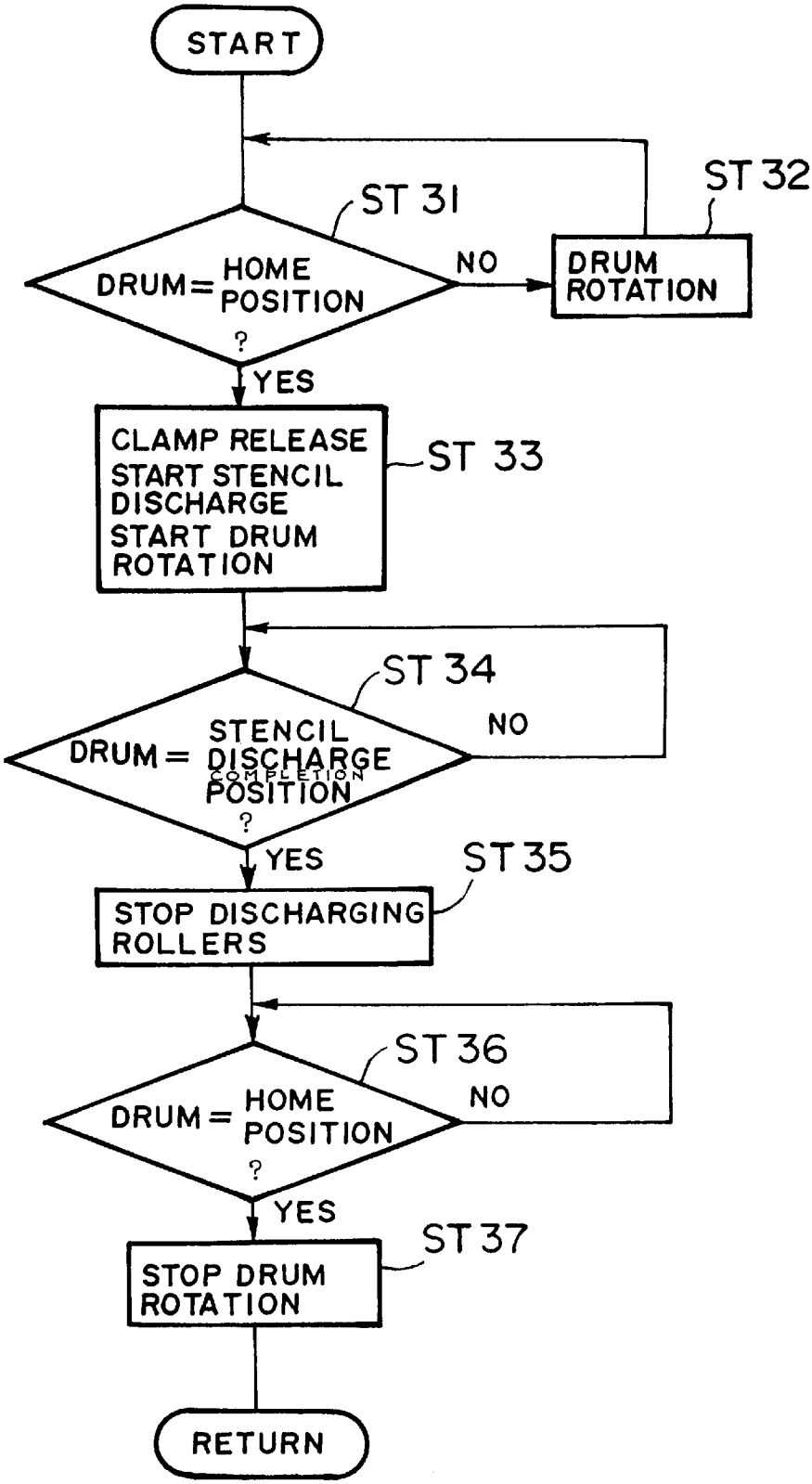
FIG. 7 is a flow chart showing the stencil discharging operation of FIG. 6.
Figure 8:
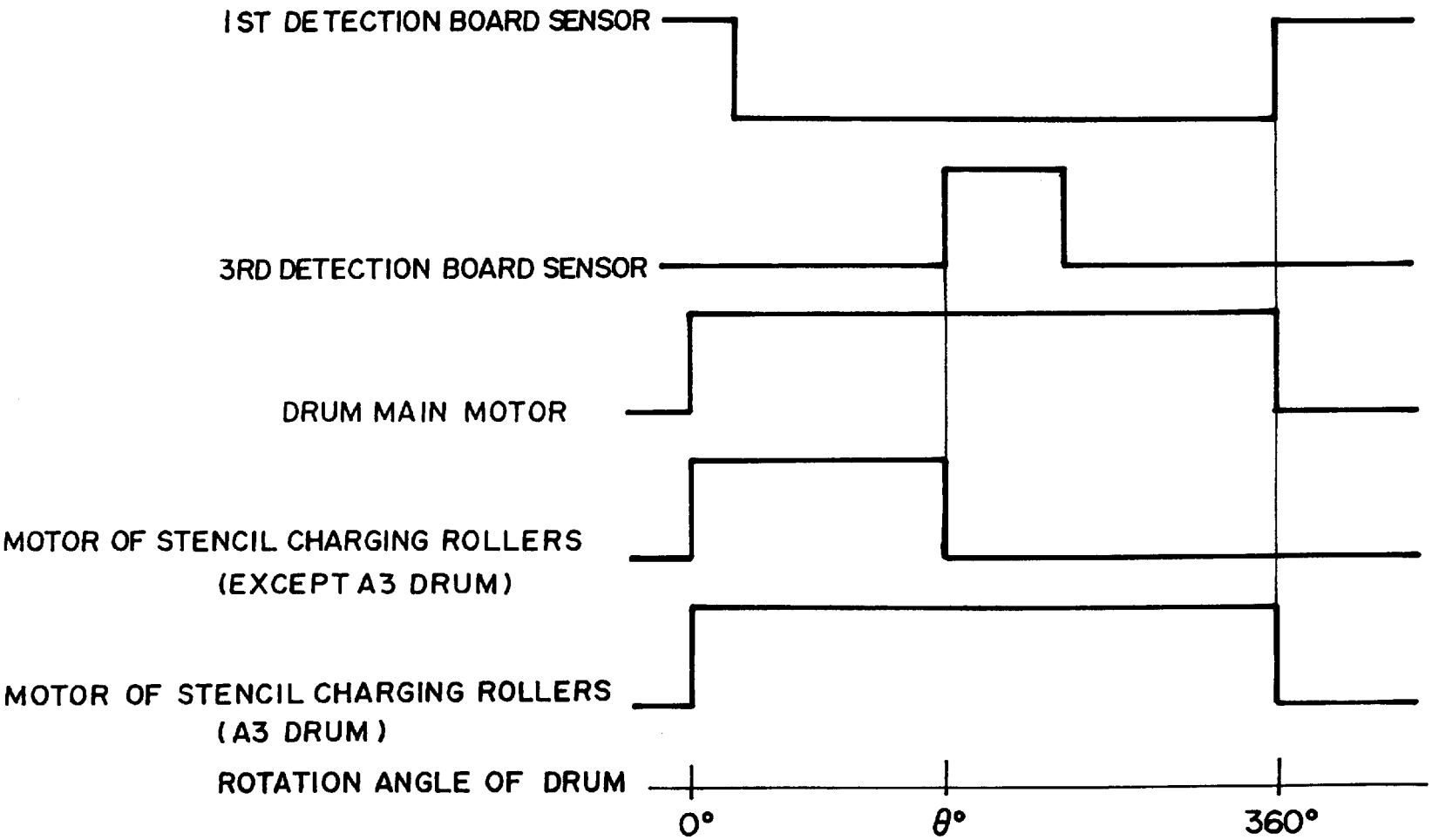
FIG. 8 is a time chart showing the stencil discharging operation of FIG. 7.

Next, the control of the operation of a pair of the stencil discharging rollers 56 conducted in the used-stencil discharging operation (Step ST3) of the flow chart of FIG. 6 will be described with reference to a flow chart shown in FIG. 7 and a timing chart shown in FIG. 8.

The flow of used-stencil discharging operation is started in parallel with the perforation operation (Step ST2) by depressing the start button by the operator. First, the rotary cylindrical drum 2 is positioned at the position at which the first detection board 87 overlaps the sensor 85, namely, at the home position at which the shaft 16 of the clamp of the drum 2 is just above (ST31 and ST32). Then, clamp solenoid 18 is activated so that the drive gear 19*a* is engaged with the gear 17 provided above the rotary cylindrical drum 2 which is held stopped at the home position. Under this condition, the clamp motor is operated to swing the stencil clamping board 5 to the clamp releasing position. Simultaneously or when a predetermined period of time passes which is required for the drive gear 19*a* to disengage from the gear 17 with the aid of the clamp solenoid 18 after the clamp opening operation, the stencil discharging operation is started (ST33). In the stencil discharging operation, the stencil-discharging-claw driving solenoid 53 is activated to cause the stencil discharging claw 51 to move to the stencil separating position, and the stencil conveying motor 83 is activated to rotate a pair of the stencil discharging rollers 56, and the main motor 3 is rotated at a very low rotation speed to turn the drum 2. As a result, the used stencil wound on the outer cylindrical surface of the drum 2 is removed from the drum 2 with the stencil discharging claw 51 as the drum 2 turns, and the used stencil thus removed is conveyed into the used-stencil accommodating box 57 while being held by a pair of the stencil discharging rollers 56.

When a pair of stencil discharging rollers 56 accommodate wholly the stencil sheet S wound around the drum 2 in the used-stencil accommodating box 57, namely, when passage of the third detection board 86 through the drum home position sensor 85 is detected in the case of the drum 2 being for other than size A3, and when passage of the first detection board 87 through the sensor 85 is detected in the case of the drum 2 being for size A3, the stencil conveying motor 83 is turned off to stop conveying operation of a pair of the stencil discharging rollers 56 (ST34, ST35). Therefore, a pair of stencil discharging rollers 56 do not unnecessarily operate after the stencil sheet S are accommodated in the used-stencil accommodating box 57, and thus there is no problem that the stencil sheet S once accommodated in the used-stencil accommodating box 57 twines with discharging roller 55 and comes out of the box. Thereafter, after the drum 2 is restored to the home position (ST36, ST37), it is wound with stencil sheet (ST4). According to this construction, even when stencil making operation is conducted immediately after replacing the drum, the operation of the pair of stencil discharging rollers 56 can be stopped at a time appropriate to the type of the loaded drum without any preliminary operation. Therefore, the information on the time of stopping the pair of stencil discharging rollers 56 is not needed to be input as information relating to setting of dip switches 133 and 135 of the printing machine, and the operation of a pair of stencil discharging rollers 56 can be controlled in correspondence to the type of the loaded drum irrespective of using or setting of the dip switches.

Next, as another example, the embodiment according to which when the drum 2 is loaded, the type of the drum 2 is previously identified and the operation of the stencil discharging roller 55 at the time of stencil discharging is controlled based on the information of the identification will be explained referring to FIG. 9 and FIG. 10. As can be seen from FIG. 9, this example differs from the control of FIG. 6 in that the former has a stage of drum type detection operation (ST1) before the perforation operation (ST2) and the stencil discharging operation (ST3).

Figure 10:
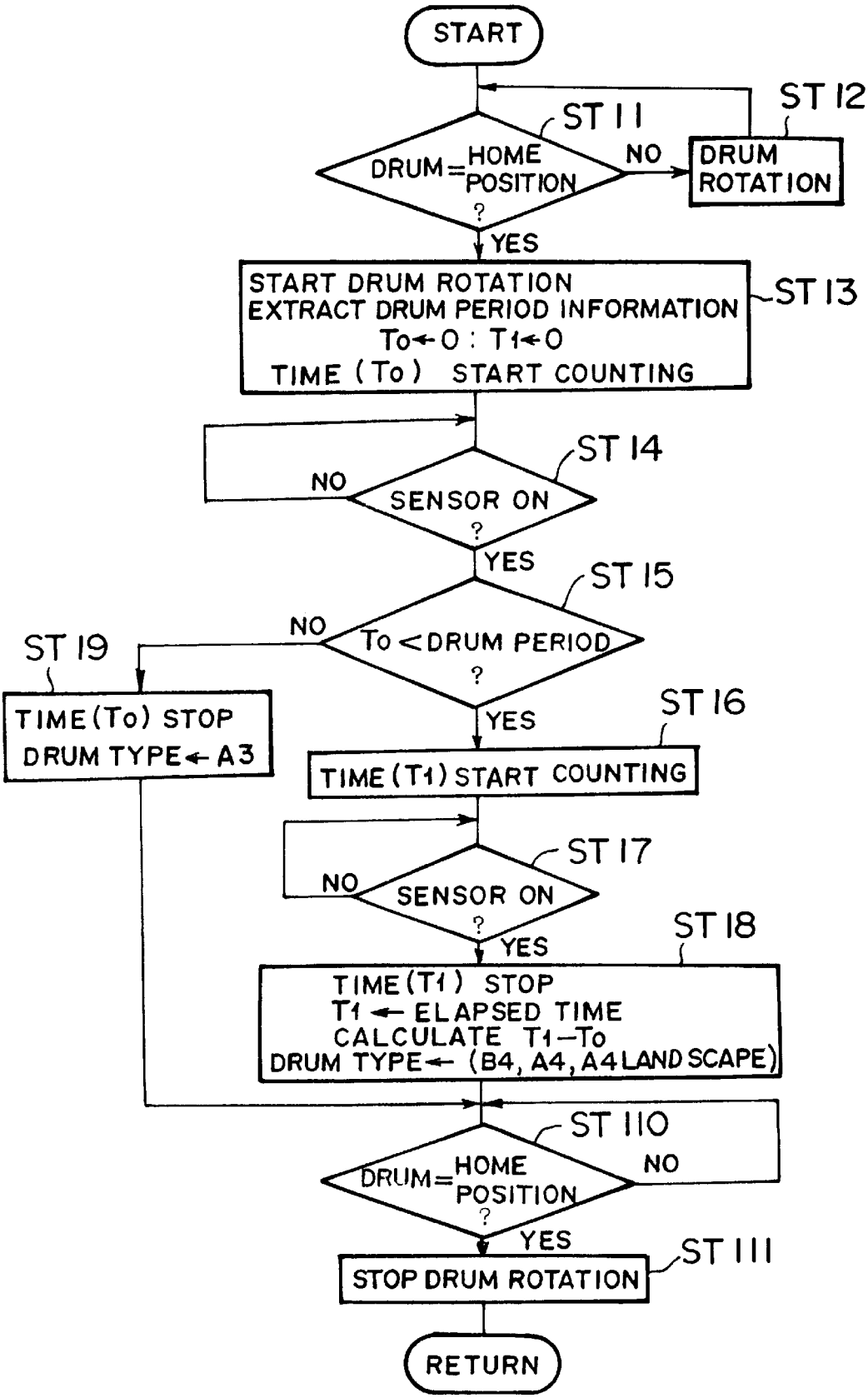
FIG. 10 is a flow chart showing the drum type detection operation of FIG. 9.

The drum type detection operation (ST1) can be carried out in accordance with the flow chart of FIG. 10. As aforementioned, the relative position of the second detection board 84 or the third detection board 86 in respect to the first detection board 87 as shown in FIG. 4 is inherent to the type of the drum, and, hence, the type of the drum can be identified by previously detecting the relative position at the time of loading of the drum in accordance with FIG. 10.

As shown in FIG. 10, when the start button is operated by user after drum 2 on which used stencil sheet S is wound is loaded in the printing machine, the drum type detection operation (ST1) is started, and first the drum 2 is set at the position at which the first detection board 87 overlaps the sensor 85, namely, the home position at which the shaft 16 of the clamp of the drum 2 is just above (ST1 and ST12). The main motor 3 is activated to rotate the drum 2 at a slight speed and simultaneously the values of periodic information T0 and T1 of the drum 2 stored in RAM 202 are initialized to 0 and count of T0 is started (ST13). When the third detection board 86 provided at the drum 2 passes through the sensor 85, count of T0 is stopped and time of T0 is obtained (ST14). Simultaneously, when the time of T0 is smaller than the period of the drum (ST15), count of T1 is started (ST16), and then, when the first detection board 87 passes through the sensor 85 (ST17), count of T1 is stopped and time of T1 is obtained (ST18). Since the time of T1 is inherent to the type of printing region of drum 2, the type of drum 2 can be detected by reference to the relation between the type of drum and the time of T1 shown in Table 1 which are previously stored in ROM 201. On the other hand, when the time of T1 is more than the period of the drum, the type of drum 2 is judged to be the maximum size (for instance, the size A3 ) (ST15, ST19). Thus, after the detection of the type of drum 2, drum 2 is restored to the same home position as mentioned above, and rotation of the drum is stopped (ST110 and ST111). In FIG. 10, T0 and T1 are time of rotation of drum 2 before and after the third detection board 86 passes through the sensor 85, but they can be time before and after the second detection board 84 passes through the sensor 85. In this way, when the type of drum is identified using the second detection board 84 or the third detection board 86, the type of drum can be identified only by loading the drum 2 irrespective of using or setting of dip switches 133 and 135, and this is convenient. Furthermore, since it becomes possible to know the type of drum by reading the difference in angle between the first detection board and the second or third detection board, the information on the type of drum may be displayed on the operation panel so that a user can easily judge the sheet size usable among the papers placed on the paper supplying stand in accordance with the display.

In the subsequent stencil discharging operation (ST3), the operation of a pair of the stencil discharging rollers 56 can be controlled as mentioned above in accordance with FIG. 7 and FIG. 8. Alternatively, since the type of drum 2 has been known in accordance with the flow chart of FIG. 10, the step of judging whether the drum reaches the stencil discharging completion position may be done by referring to the relation between the type of drum and the stencil discharging completion position θ exemplified in Table 1 which have been previously stored in ROM 201 (ST35) (ST34), and the operation of a pair of the stencil discharging rollers 56 may be stopped when an encoder (not shown) connected to the drum 2 or main motor 3 thereof detects that the drum reaches the stencil discharging completion position θ under monitoring the rotation angle of the drum by the encoder. Furthermore, it is also possible that the rotation angle θ of the drum at the time when the third detection board 86 passes through the sensor 85 is calculated from T0 and T1 and stored in RAM 202 and the operation of a pair of the stencil discharging rollers 56 is stopped when the encoder detects that the rotation angle of the drum reaches the value of θ stored in RAM 202, without referring to Table 1 stored in ROM 201 (ST35). In this case, the value of θ may not correspond to the standard size such as A4, B4 or the like, and rotation of a pair of the stencil discharging rollers 56 can be controlled in correspondence with the drum having optional printing region.

TABLE 1

| Sheet size | A3 | B4 | A4 | A4 landscape |
|---|---|---|---|---|
| Stencil discharging completion position | θ = 360° | θ = 328° | θ = 290° | θ = 240° |

Figure 11:
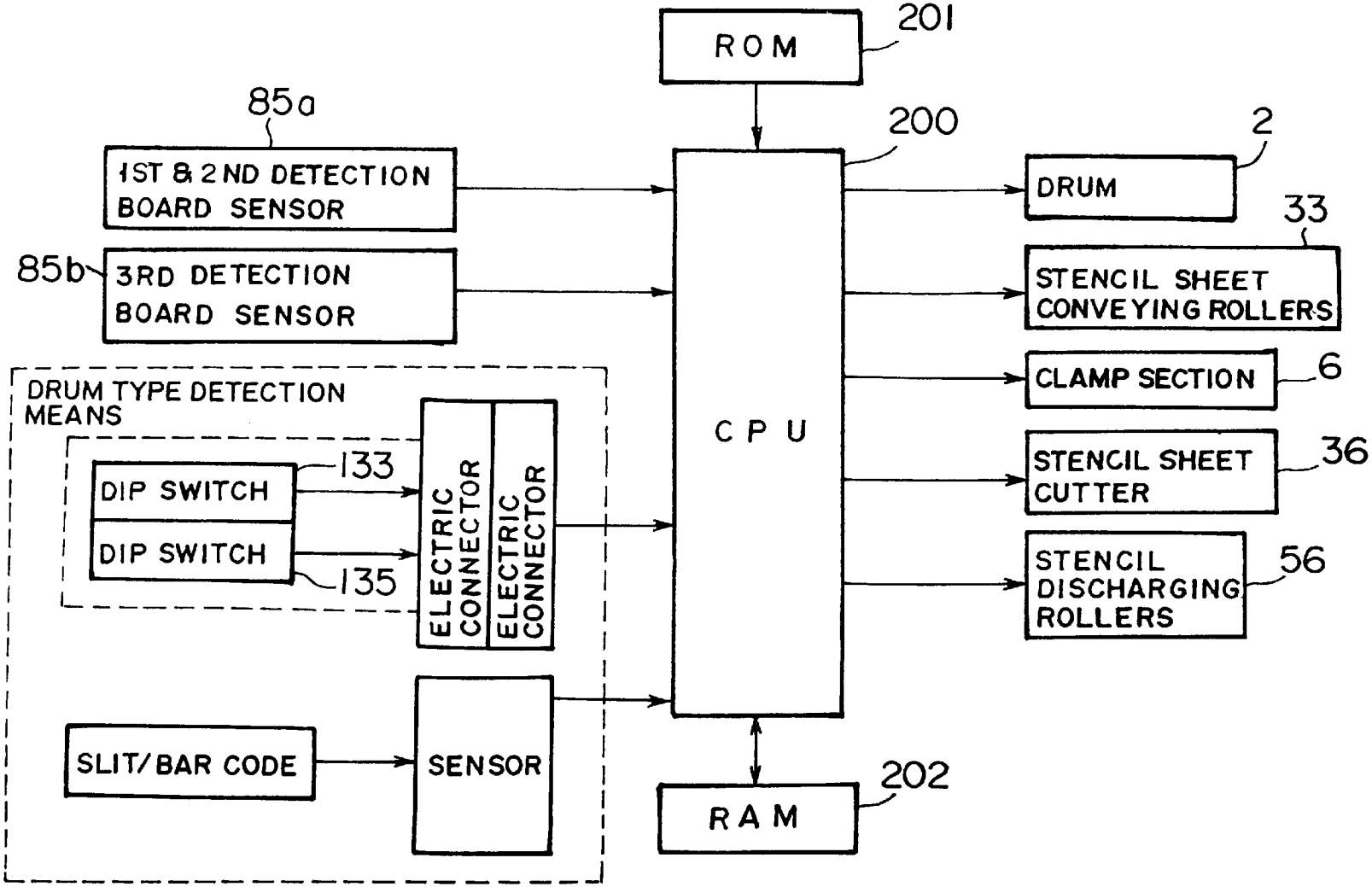
FIG. 11 is a block diagram showing an arrangement of another example of a control system of the printing machine.

Next, still another example, in which the type of drum 2 is identified by drum type detecting means such as dip switches 133 and 135 shown in FIG. 11 and aforementioned slits or bar cord, and the operation of a pair of the stencil discharging rollers 56 at the time of stencil discharging is controlled based on the identification information will be explained referring to FIG.11 and FIG. 12. This example is the same as the above-mentioned example in that the control is carried out in accordance with the flow chart shown in FIG. 9, but differs from the control of FIG. 9 in that the drum type detection operation (ST1) is carried out in accordance with the flow chart of FIG. 12.

Figure 12:
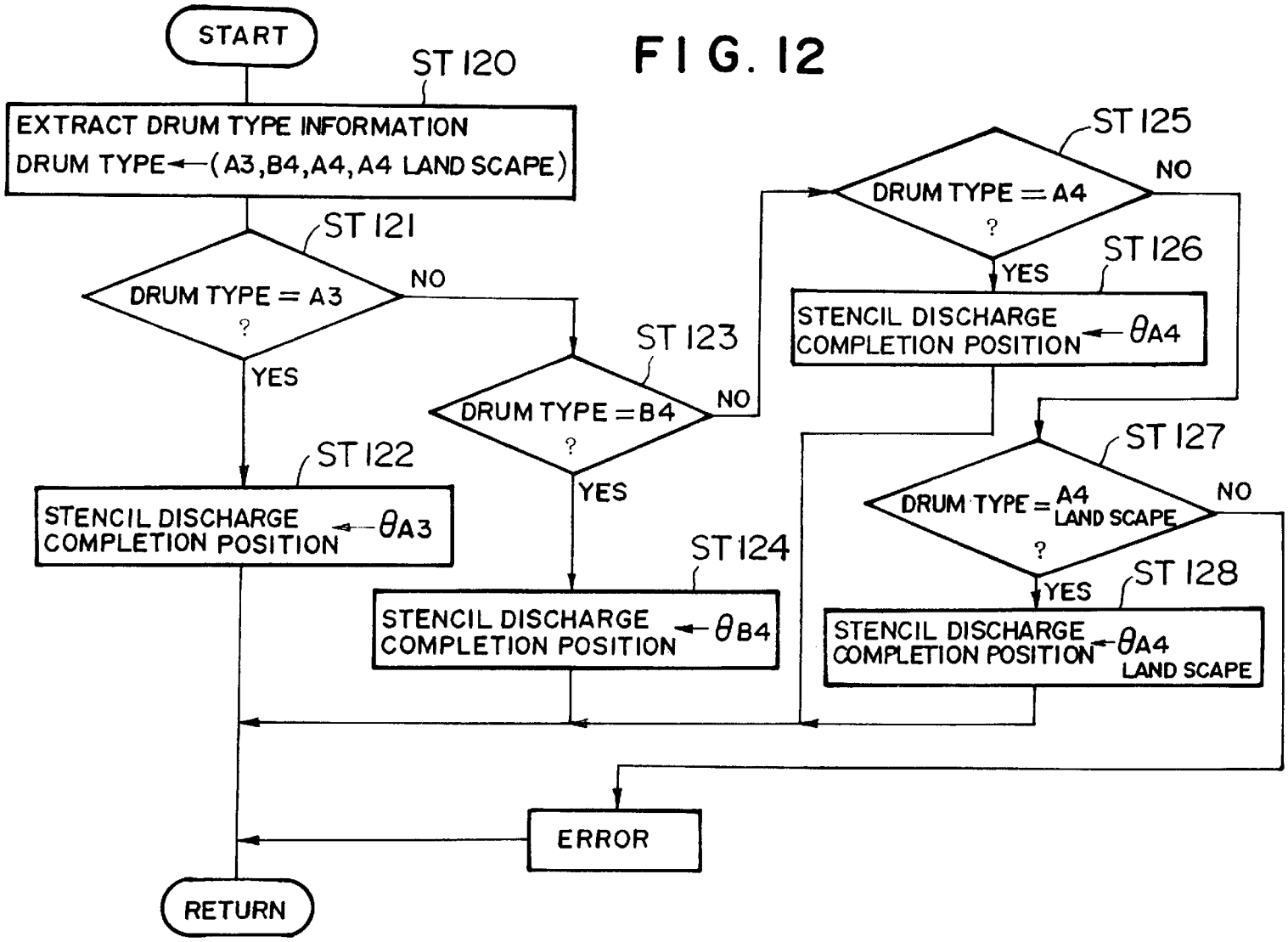
FIG. 12 is a flow chart showing the drum type detection operation in the control system of FIG. 11.

In FIG. 12, when the start button is operated by a user, the type of drum 2 is judged by extracting information of the drum type detecting means (ST120) as to whether it is for size A3 or not (ST121), and in the case of being for size A3 , the stencil discharging completion position of the drum is set at θ=360° with reference to the relation between the type of the drum and the stencil discharging completion position θ of the drum exemplified in Table 1 which are previously stored in ROM 201 (ST122). In the case of the drum 2 being not for size A3 , it is further judged whether it is for size B4 or not (ST123). When it is for size B4, the stencil discharging completion position of the drum is set at θ=328° with reference to ROM 201 as mentioned above (ST124). In the case of the drum 2 being not for size B4, it is further judged whether it is for size A4 or not (ST125). When it is for size A4,the stencil discharging completion position of the drum is set at θ=290° with reference to ROM 201 as mentioned above (ST126). In the case of the drum 2 being not for size A4,it is further judged whether it is for size A4 (landscape) or not (ST127). When it is for size A4 (landscape), the stencil discharging completion position of the drum is set at θ=240° with reference to ROM 201 as mentioned above (ST128). In the case of the drum 2 being not for size A4 (landscape), this is processed to be error and indicated to the user by a suitable warning means.

Figure 9:
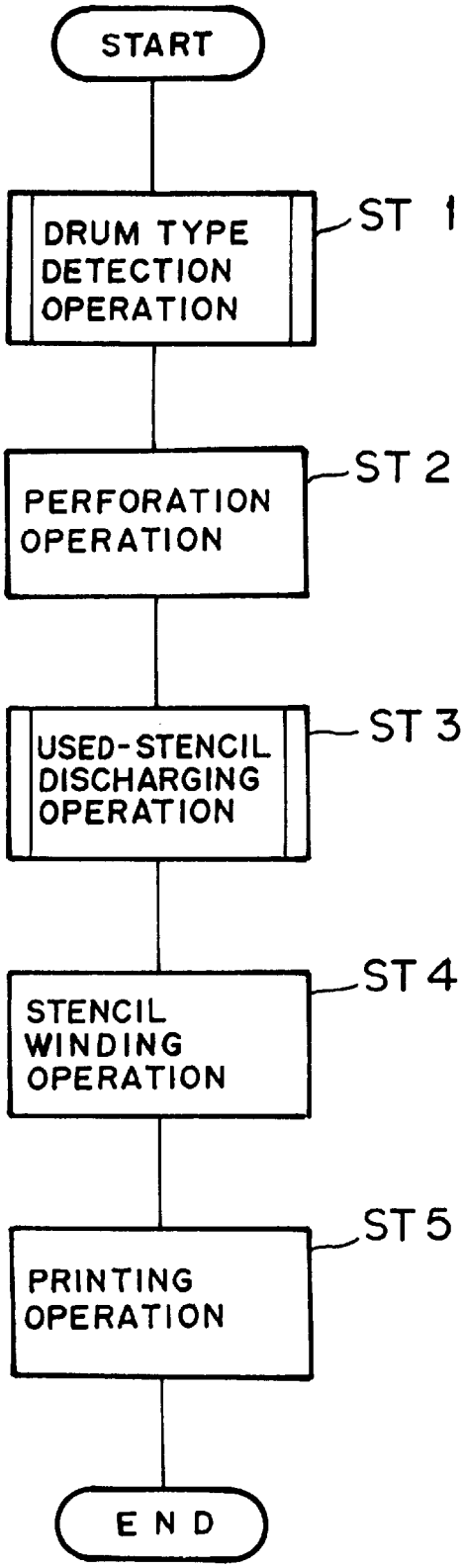
FIG. 9 is a flow chart showing another example of the operating steps of the printing machine.

Thus, after the type of drum is identified in accordance with FIG. 12, the subsequent perforating operation (ST2), used-stencil discharging operation (ST3) and others are carried out in accordance with FIG. 9. The used-stencil discharging operation (ST3) is carried out according to the flow chart of FIG. 7. In order to judge that the drum has reached the stencil discharging completion position (ST34), rotation angle of the drum 2 is monitored by an encoder (not shown) which is connected to the drum 2 or a main motor thereof. The pair of stencil discharging rollers 56 may be stopped when the drum has reached the stencil discharging completion position θ that has previously been retrieved in the flow chart of FIG. 12 by the printing machines (ST35).

According to the stencil-making type printing machine of the present invention, since a detecting means which detects a point of time when the whole stencil sheet is accommodated in a used-stencil accommodating box by a conveying means and a controlling means which stops the conveying operation of the conveying means in response to the detecting means are provided, even in the case of frequently replacing and using drums differing in size of printing region, the operation of the conveying means can be stopped at a time of completing stencil discharge depending on the type of drum. Therefore, not only unnecessary operation of the conveying means can be inhibited, but also the stencil once accommodated in the used-stencil accommodating box can be prevented from twining with the conveying means and coming out of the used-stencil accommodating box.

Noticing that the process of accommodation of the stencil sheet in the accommodating box has correlation with rotation angle of the drum, one embodiment of the invention employs a first detection board fixed at a flange of the drum and another detection board fixed at the flange of the drum apart from the first detection board by the said rotation angle in the direction reverse to the rotating direction of the drum, as well as a stationary sensor which detects both of these detection boards, as detecting means which detect rotation angle of the drum at the time of the whole stencil sheet is accommodated in the used-stencil accommodating box. In this case, the operation of the conveying means can be it stopped at a time corresponding to the type of drum without any process of previously identifying the type of the drum even if the perforation operation is carried out immediately after replacing the drum.

Alternatively, the present control system may include a process or means for detecting the type of the loaded drum together with a set of information on the relationship between the types of usable drums and their rotation angles at the time when the whole stencil sheet is accommodated in the used-stencil accommodating box. The information is previously given to the printing machine. In this case, it is possible to extract the rotation angle based on the type of the drum identified by the drum type detecting means, and to stop the operation of the conveying means on the condition that the drum has reached the above rotation angle with monitoring the rotation angle of the drum with time. This is convenient in that the object of the present invention can be attained without additional detection boards, thereby avoiding an increase in the number of parts of the drum.

What is claimed is:

1. A stencil making printing machine comprising:

a rotary cylindrical drum having a printing region, a cutting apparatus for cutting a stencil sheet to a size corresponding to the printing region, a loading apparatus which provides a cut stencil sheet onto said rotary cylindrical drum, a printing apparatus utilizing said rotary cylindrical drum, a stencil discharging apparatus which discharges a used cut stencil sheet from said rotary cylindrical drum, a conveying apparatus for conveying a discharged used cut stencil sheet from said stencil discharging apparatus, a used-stencil accommodating box to receive the discharged used cut stencil sheet from said conveying apparatus, and a control system which controls the duration of the operating time of said conveying apparatus based on the rotational position of said rotary cylindrical drum, and wherein a plurality of rotary cylindrical drums, each drum having a specific size printing region, are provided, and wherein the stencil sheet is provided to said cutting apparatus in roll form.

2. A printing machine as claimed in claim 1, wherein said control system comprises a detecting means which detects a point of time at which the whole of said used stencil is accommodated in said used-stencil accommodating box and a control means which stops conveying operation of said conveying apparatus in response to information provided by said detecting means.

3. A printing machine as claimed in claim 2, wherein said used stencil is wholly accommodated in said used-stencil accommodating box during one rotation of said drum, and said detecting means is a means which detects a rotation angle of said drum at a point of time when said used stencil is wholly accommodated in said used-stencil accommodating box.

4. A printing machine as claimed in claim 3, wherein said detecting means comprises a first detection board fixed at a peripheral edge of said drum, a second detection board fixed at a peripheral edge of said drum apart from said first detection board by said rotation angle in reverse direction to the rotation of said drum, and a stationary sensor which detects both said first and second detection boards.

5. A printing machine as claimed in claim 4, wherein said first detection board is provided at a position where it is detected by said sensor when said drum begins to rotate in discharging of used-stencil, and said control means stops the conveying operation of said conveying means in response to detection of said second detection board by said sensor.

6. A printing machine as claimed in claim 2, wherein said used stencil is wholly accommodated in said used-stencil accommodating box during one rotation of said drum, and said detecting means comprises a means for detecting a type of a loaded rotary cylindrical drum and a means for detecting a rotation angle of said drum at a point of time when said used stencil is wholly accommodated in said used-stencil accommodating box.

7. A printing machine as claimed in claim 6, in which said loaded drum type detecting means comprises a first detection board fixed at a peripheral edge of said drum, a second detection board fixed at a peripheral edge of said drum apart from said first detection board by said rotation angle in reverse direction to the rotation of said drum, and a stationary sensor which detects both said first and second detection boards, said rotation angle detecting means comprising a memory means which memorizes said rotation angle obtained based on detection of both said first and second detection boards by said sensor and a drum rotation monitoring means which monitors the rotation angle of said drum to detect that said drum has rotated up to the rotation angle memorized in said memory means, and said control means being a means which stops the conveying operation of said conveying apparatus in response to the detection of said memorized angle by said drum rotation monitoring means.

8. A printing machine as claimed in claim 2, wherein said used stencil is wholly accommodated in said used-stencil accommodating box during one rotation of said drum, in which said detecting means comprises a means for detecting a type of a loaded rotary cylindrical drum, a first memory means for storing information on all usable types of rotary cylindrical drums and corresponding rotation angles at a point of time when said used stencil is wholly accommodated in said used-stencil accommodating box, a second memory means for retrieving and memorizing a rotation angle from said first memory means depending on the type of a drum detected by said means for detecting a type of a loaded drum, and a drum rotation monitoring means which monitors the rotation angle of said drum to detect that said drum has rotated up to said rotation angle memorized in said second memory means, said control means being a means which stops the conveying operation of said conveying apparatus in response to the detection by the drum rotation monitoring means of said rotation angle memorized in said second memory means.

9. A printing machine as claimed in claim 8, wherein said means for detecting a type of a loaded rotary cylindrical drum comprises a first detection board fixed at a peripheral edge of a drum, a second detection board fixed at a peripheral edge of said drum apart from said first detection board by an angle that differs depending on types of drums, and a stationary sensor which detects both said detection boards.

10. A printing machine as claimed in claim 8, wherein said means for detecting a type of a loaded rotary cylindrical drum comprises dip switches or slits disposed on drums.

11. A stencil making printing machine comprising:

a rotary cylindrical drum having a printing region; wherein said rotary cylindrical drum is selected to have a desired size printing region, a stencil paper providing apparatus which provides stencil paper to a cutting apparatus in roll form, a cutting apparatus which cuts said stencil paper to a size corresponding to the printing region, a loading apparatus which provides a cut stencil paper onto said rotary cylindrical drum, a printing apparatus utilizing said rotary cylindrical drum, a stencil discharging apparatus which discharges a used cut stencil sheet from the rotary cylindrical drum, a conveying apparatus which conveys a discharged used cut stencil sheet from said stencil discharging apparatus, a used-stencil accommodating box which receives the discharged used cut stencil sheet from said conveying apparatus, and a control system which controls the duration of the operating time of said conveying apparatus based on the rotational position of said rotary cylindrical drum.

* * * * *